US009902579B2

(12) United States Patent
Cheng

(10) Patent No.: US 9,902,579 B2
(45) Date of Patent: Feb. 27, 2018

(54) FEEDING DEVICE WITH SLIDE

(71) Applicant: AVISION INC., Hsinchu (TW)

(72) Inventor: Sung-Po Cheng, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/886,115

(22) Filed: Oct. 19, 2015

(65) Prior Publication Data

US 2016/0122143 A1 May 5, 2016

(30) Foreign Application Priority Data

Oct. 30, 2014 (TW) ..... 103137553 A

(51) Int. Cl.

| | |
|---|---|
| ***B65H 3/06*** | (2006.01) |
| ***B65H 3/52*** | (2006.01) |
| ***B65H 3/04*** | (2006.01) |
| ***B65H 3/66*** | (2006.01) |
| ***B65H 7/00*** | (2006.01) |

(52) U.S. Cl.

CPC ..... *B65H 3/063* (2013.01); *B65H 3/042* (2013.01); *B65H 3/0669* (2013.01); *B65H 3/523* (2013.01); *B65H 3/5238* (2013.01); *B65H 3/66* (2013.01); *B65H 7/00* (2013.01); *B65H 2403/42* (2013.01); *B65H 2403/72* (2013.01); *B65H 2511/20* (2013.01); *B65H 2511/212* (2013.01)

(58) Field of Classification Search

CPC ..... B65H 1/06; B65H 3/063; B65H 3/0638; B65H 3/04; B65H 3/042; B65H 3/047; B65H 3/5238; B65H 3/54; B65H 3/34

See application file for complete search history.

(56) References Cited

U.S. PATENT DOCUMENTS

| | | | | |
|---|---|---|---|---|
| 7,357,386 | B2 * | 4/2008 | Shikan | B65H 1/24 271/10.09 |
| 2007/0063421 | A1 * | 3/2007 | Demmeler | B65H 3/06 271/121 |
| 2009/0026692 | A1 * | 1/2009 | Iwami | B65H 3/0638 271/118 |

FOREIGN PATENT DOCUMENTS

| | | | | |
|---|---|---|---|---|
| CN | 1803562 | A | 7/2006 | |
| CN | 201002893 | Y | 1/2008 | |
| CN | 101198533 | A | 6/2008 | |
| CN | 201102825 | Y | 8/2008 | |
| CN | 204324467 | U | 5/2015 | |
| DE | 19519029 | A1 * | 11/1996 | B65H 1/24 |
| JP | 08244993 | A * | 9/1996 | |
| JP | 8310672 | | 11/1996 | |
| JP | 08310672 | A * | 11/1996 | |
| JP | 8310672 | A | 11/1996 | |
| JP | 1035897 | | 2/1998 | |
| JP | 1035897 | A | 2/1998 | |
| JP | 10035897 | A * | 2/1998 | |
| TW | M483178 | U | 8/2014 | |

(Continued)

*Primary Examiner* — Luis A Gonzalez

(57) ABSTRACT

A feeding device for a digital processing machine includes a paper passage, a sheet-feeding roller, a friction device, and a slide. The sheet-feeding roller is disposed in the paper passage, and the friction device is disposed opposite to the sheet-feeding roller. The sheet-feeding roller separates a sheet with the friction device. The slide is disposed at a left side and a right side of the sheet-feeding roller. The slide is lowered from a first position to a second position when the sheet-feeding roller rotates, such that the sheet contacts the sheet-feeding roller.

11 Claims, 7 Drawing Sheets

(56) References Cited

FOREIGN PATENT DOCUMENTS

TW M487210 U 10/2014

* cited by examiner

FEEDING DEVICE WITH SLIDE

BACKGROUND OF THE INVENTION

1. Field of the Invention

The present invention relates to a feeding device, and more particularly, to a feeding device utilizing a slide to place sheets.

2. Description of the Prior Art

Digital processing machines, such as scanners, copy machines, and multifunction printers are often equipped with automatic document feeders (ADFs) for users to put a plurality of sheets at once instead of one by one manually. Please see FIG. 9. FIG. 9 is a sectional diagram of a conventional feeding device in the prior. As shown in FIG. 9, a plurality of sheets S is put in a paper passage P. A feeding device senses the sheets S and drives a sheet-feeding roller A to rotate. The sheet-feeding roller A cooperates with a friction pad B to separate the plurality of sheets S and feed the plurality of sheets S one by one to the paper passage P at a downstream side of the sheet-feeding roller A. However, the sheets S may not be so rigid that the sheets S contact the sheet-feeding roller A first when being placed. A surface of the sheet-feeding roller A is made of rough material, so as to separate the sheets S easily. A friction force generated between the sheet-feeding roller A and the sheets S makes the sheets S bent easily when the sheets are placed and the feeding device is not activated. When the feeding device is activated and the sheet-feeding roller A begins rotating, the bent sheets S will be creased and damaged, which leads to a paper jam and a feeding failure, especially feeding the thin sheets S.

FIG. 10 is a sectional diagram of another conventional feeding device in the prior art. As shown in FIG. 10, a pickup roller C is added at an upstream side of the sheet-feeding roller A. The pickup roller C holds and conveys the plurality of sheets S to the sheet-feeding roller A and the friction pad B. The sheets S contact the pickup roller C when being placed. Similarly, the pickup roller C is made of material with a high friction coefficient, and such a situation of the bent sheets S also happens to the pickup roller C. Since a paper jam causes damage to sheets and inconvenience when people use digital processing machines, there is a need to develop an effective mechanism to solve the above-mentioned problems.

SUMMARY OF THE INVENTION

In order to solve the above-mentioned drawbacks, the present invention is to provide a feeding device utilizing a slide to place sheets for protecting sheets from damage and ensuring a smooth sheet-feeding process.

According to the claimed invention, a feeding device for a digital processing machine includes a paper passage, a sheet-feeding roller, a friction device, and a slide. The sheet-feeding roller is disposed on the paper passage. The friction device is disposed at a location opposite to the sheet-feeding roller. The sheet-feeding roller separates a sheet with the friction device. The slide is disposed by a left side and a right side of the sheet-feeding roller. The slide is lowered from a first position to a second position when the sheet-feeding roller rotates, such that the sheet contacts the sheet-feeding roller.

According to the claimed invention, the slide is disposed at an axle of the sheet-feeding roller.

According to the claimed invention, the slide is higher than the sheet-feeding roller when the slide is at the first position, and the slide is lower than the sheet-feeding roller when the slide is at the second position.

According to the claimed invention, the feeding device further includes a one-way bearing sheathed on an axle of the sheet-feeding roller. The one-way bearing lowers the slide from the first position to the second position when the sheet-feeding roller rotates.

According to the claimed invention, a feeding device for a digital processing machine includes a paper passage, a pickup roller, a sheet-feeding roller, a friction device, and a slide. The pickup roller is disposed on the paper passage for picking up a sheet. The sheet-feeding roller is disposed on the paper passage and at a downstream side of the pickup roller. The friction device disposed at a location opposite to the sheet-feeding roller. The slide is disposed by a left side and a right side of the pickup roller. The slide is lowered from a first position to a second position when the pickup roller rotates, such that the sheet contacts the pickup roller.

According to the claimed invention, the slide is disposed at an axle of the pickup roller.

According to the claimed invention, the slide is higher than the pickup roller when the slide is at the first position, and the slide is lower than the pickup roller when the slide is at the second position.

According to the claimed invention, the feeding device further includes a one-way bearing sheathed on an axle of the pickup roller. The one-way bearing lowers the slide from the first position to the second position when the pickup roller rotates.

According to the claimed invention, the feeding device further includes a belt encircling an axle of the pickup and an axle of the sheet-feeding roller. The belt drives the sheet to pass through the paper passage.

According to the claimed invention, the feeding device further includes an additional pickup roller and an additional sheet-feeding roller. The pickup roller and the additional pickup roller are coaxially disposed with each other, and the sheet-feeding roller and the additional sheet-feeding roller are coaxially disposed with each other.

In summary, the present invention provides the feeding device with the slide capable of switching between the first position and the second position with different heights. The sheet contacts the slide with a lower friction coefficient first at the first position and then contacts the pickup roller or the sheet-feeding roller with a higher friction coefficient at the second position, such that the sheet can be kept flat without being bent during a sheet-feeding process, so as to ensure a smooth feeding process and protect the sheet from damage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
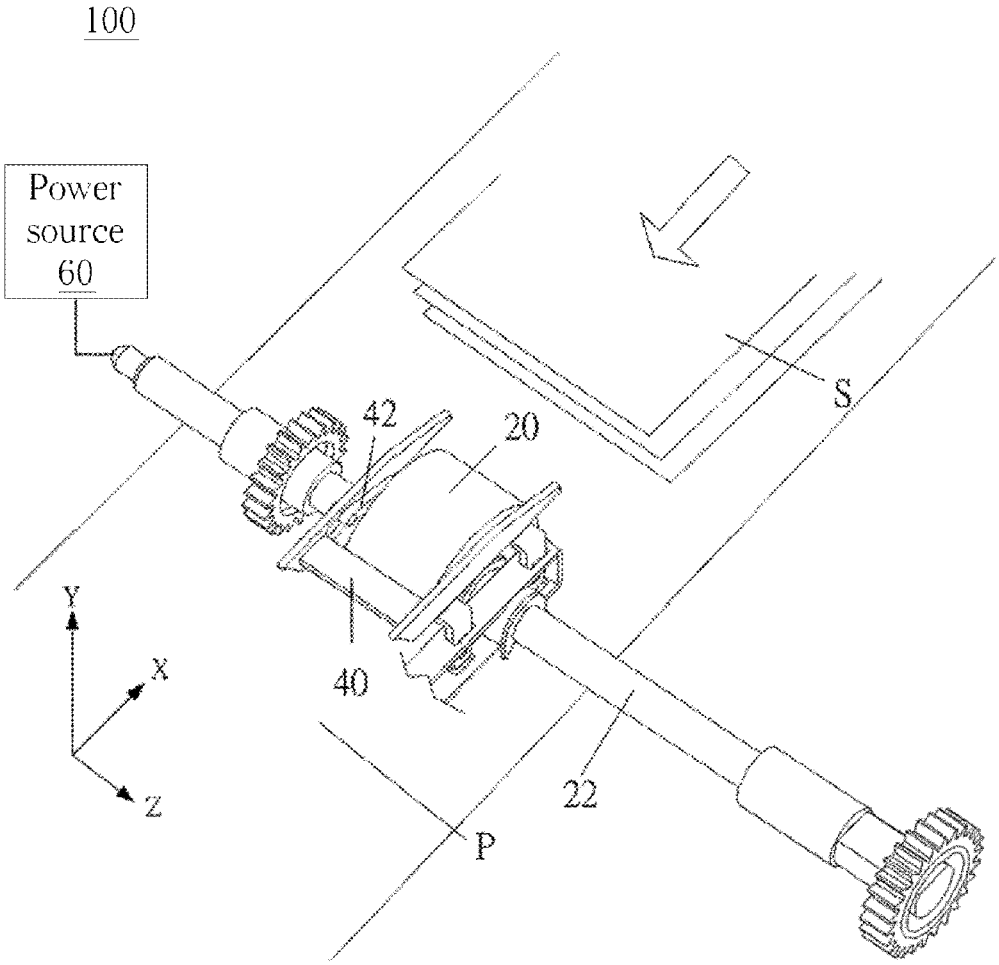
FIG. 1 is a schematic diagram of a feeding device according to a first embodiment of the present invention.
Figure 2:
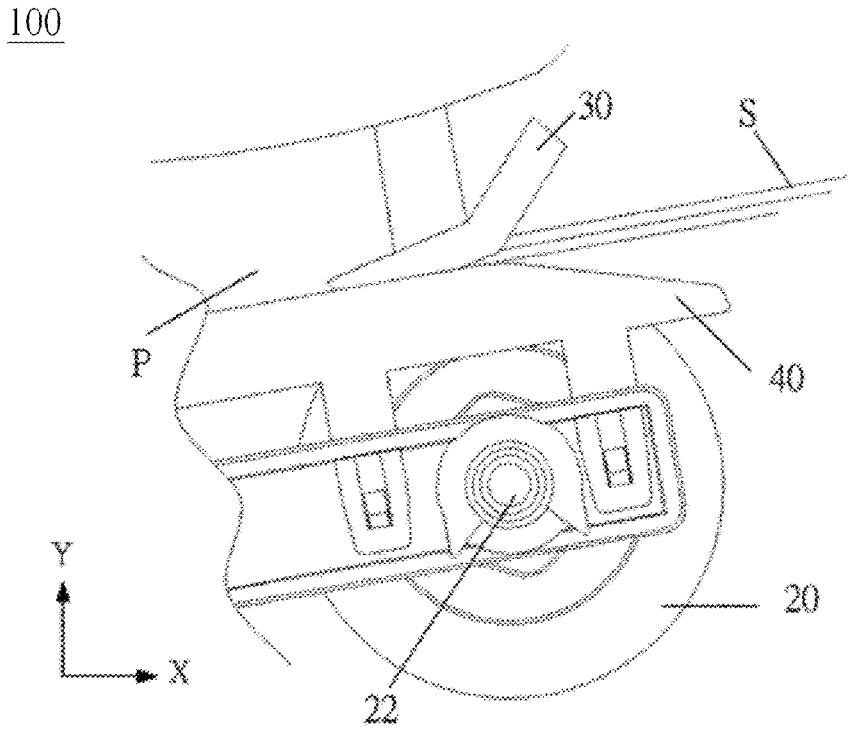
FIG. 2 is a diagram of the feeding device with a slide in a first position according to the first embodiment of the present invention.
Figure 3:
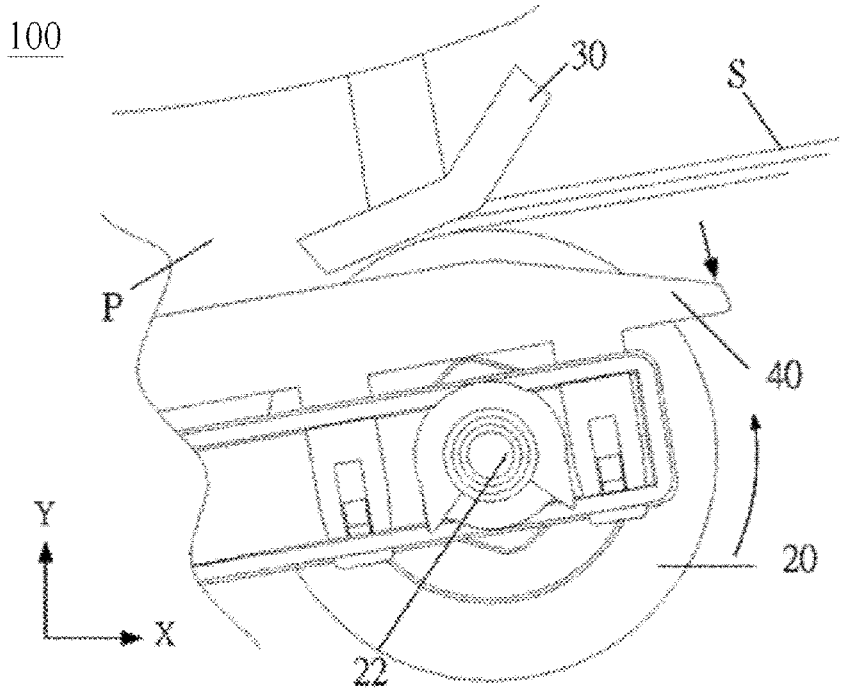
FIG. 3 is a diagram of the feeding device with the slide in a second position according to the first embodiment of the present invention.

Please refer to FIG. 1 to FIG. 3. FIG. 1 is a schematic diagram of a feeding device 100 according to a first embodiment of the present invention. FIG. 2 is a diagram of the feeding device 100 shown in FIG. 1 with a slide 40 in a first position according to the first embodiment of the present invention. FIG. 3 is a diagram of the feeding device 100 shown in FIG. 1 with the slide 40 in a second position according to the first embodiment of the present invention. The feeding device 100 adapted for a digital processing machine (not shown in figures) includes a paper passage P, a sheet-feeding roller 20, a friction device 30, and the slide 40. The sheet-feeding roller 20 is disposed on the paper passage P. The slide 40 is disposed by a left side and a right side of the sheet-feeding roller 20 and at an axle 22 of the sheet-feeding roller 20. The feeding device 100 further includes a power source 60 connected to the sheet-feeding roller 20 for driving the sheet-feeding roller 20 to rotate and to move a sheet S to a downstream side of the paper passage P. The feeding device 100 further includes a one-way bearing 42 sheathed on the axle 22 of the sheet-feeding roller 20. The one-way bearing 42 lowers the slide 40 from a first position to a second position when the sheet-feeding roller 20 rotates.

As shown in FIG. 2, the friction device 30 is disposed at a location opposite to the sheet-feeding roller 20. When the sheet S is placed, the sheet S contacts the slide 40 located at a higher location in the first position, instead of contacting the sheet-feeding roller 20 located at a lower location. The slide 40 can be a rib structure, and a contacting area between the slide 40 and the sheet S is small. The slide 40 can be made of material with a low friction coefficient, such that the sheet S is not bent by a friction force but placed flat.

As shown in FIG. 1 and FIG. 3, the power source 60 drives the sheet-feeding roller 20 to rotate in a counterclockwise direction when the feeding device 100 is activated. The one-way bearing 42 (shown in FIG. 1) lowers the slide 40 from the first position to the second position. Since the slide 40 for supporting the sheet S is lowered to the second position below the sheet-feeding roller 20, the sheet S drops and contacts the sheet-feeding roller 20 smoothly. Meantime, the sheet-feeding roller 20 rotates and cooperates with the friction device 30 to separate the plurality of sheets S one by one and to convey the sheet S to the downstream side of the paper passage P. The friction device 30 can include a friction wheel or a friction pad. In this embodiment, the friction device 30 is a friction pad but it is not limited to this embodiment. By lowering the slide 40, the sheet S can contact the sheet-feeding roller 20 flat instead of being bent.

Figure 4:
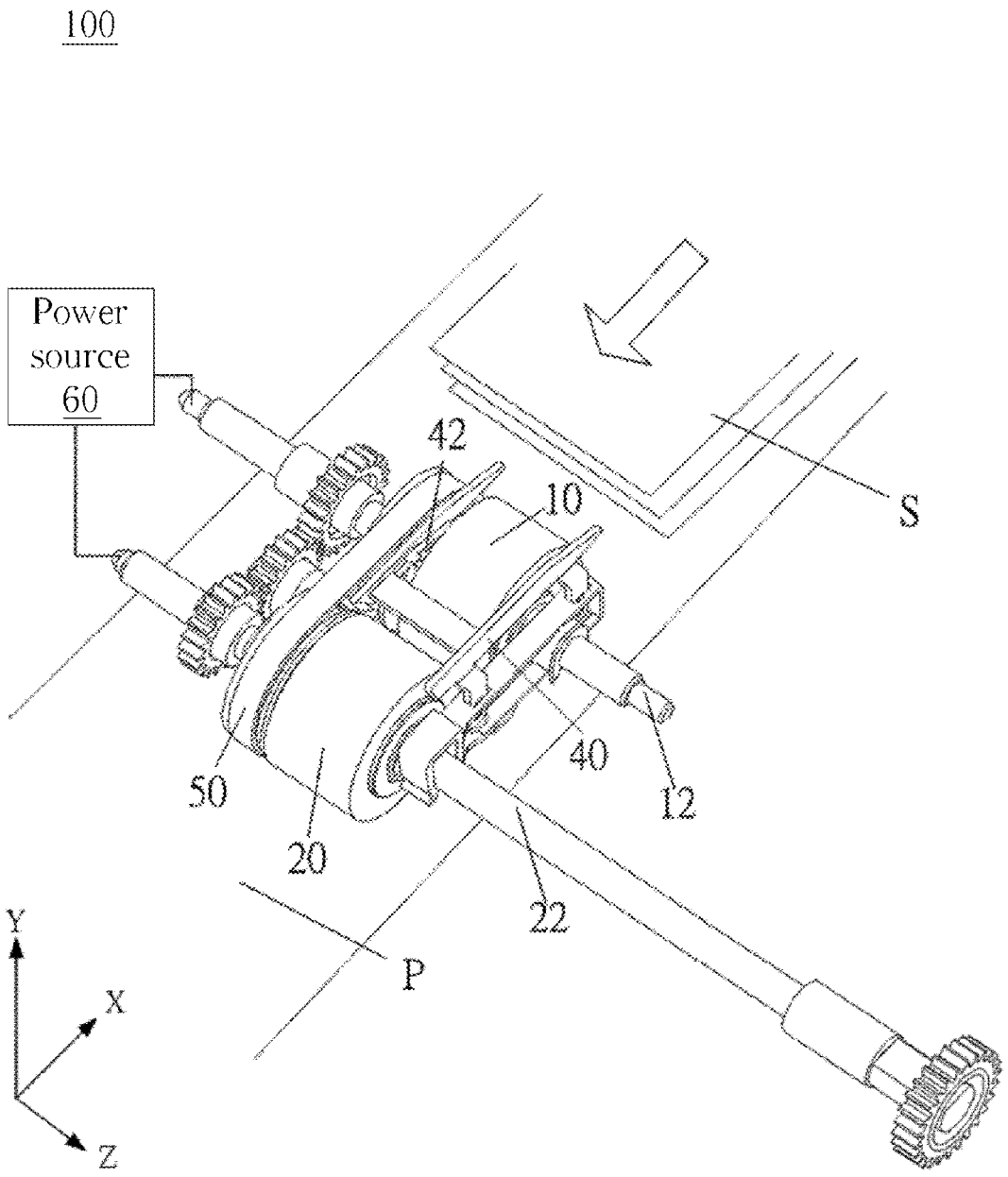
FIG. 4 is a schematic diagram of the feeding device according to a second embodiment of the present invention.
Figure 5:
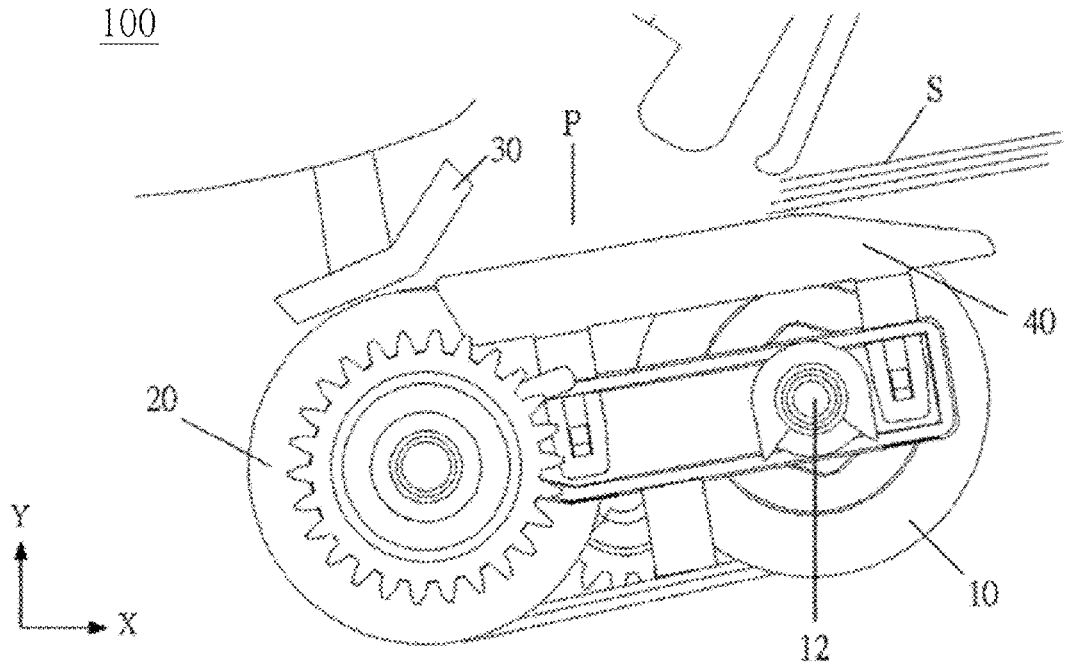
FIG. 5 is a diagram of the feeding device with the slide in a first position according to the second embodiment of the present invention.
Figure 6:
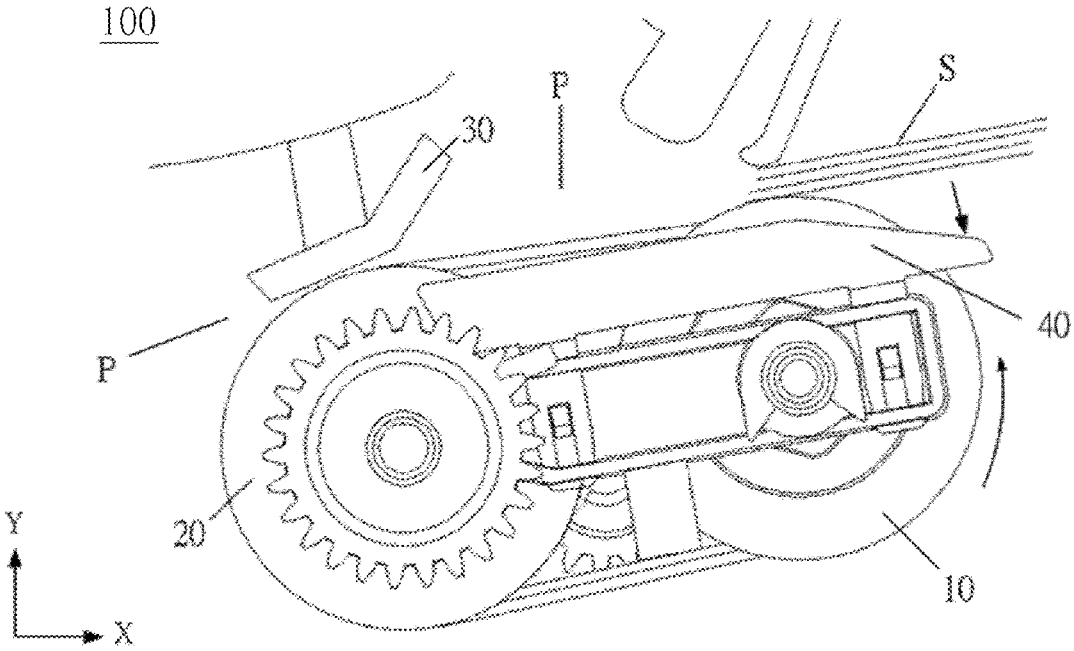
FIG. 6 is a diagram of the feeding device with the slide in a second position according to the second embodiment of the present invention.

Please refer to FIG. 4 to FIG. 6. FIG. 4 is a schematic diagram of the feeding device 100 according to a second embodiment of the present invention. FIG. 5 is a diagram of the feeding device 100 shown in FIG. 4 with the slide 40 in a first position according to the second embodiment of the present invention. FIG. 6 is a diagram of the feeding device 100 shown in FIG. 1 with the slide 40 in a second position according to the second embodiment of the present invention. The feeding device 100 includes the paper passage P, a pickup roller 10, the sheet-feeding roller 20, the friction device (shown in FIG. 5 and FIG. 6), and the slide 40. The pickup roller 10 is disposed on the paper passage P for picking up the sheet S. The sheet-feeding roller 20 is disposed on the paper passage P and located at a downstream side of the pickup roller 10. Different from the first embodiment, the feeding device 100 of the second embodiment further includes the pickup roller 10, and the slide 40 is disposed by a left side and a right side of the pickup roller 10. In this embodiment, the sheet S contacts the pickup roller 10 first. The pickup roller 10 can hold the plurality of sheets S and convey the sheets S to the sheet-feeding roller 20 and the friction device 30 for separating the sheet S. Therefore, by arrangement of the slide 40 disposed by the left side and the right side of the pickup roller 10, the sheet S is not bent when contacting the pickup roller 10. Furthermore, the feeding device 100 further includes a belt 50 encircling an axle 12 of the pickup 12 and the axle 22 of the sheet-feeding roller 20. The belt 50 is driven by the power source 60 for helping to convey the sheet S to pass through the paper passage P.

As shown in FIG. 5, the friction device 30 is disposed at a location opposite to the sheet-feeding roller 20. The slide 40 is disposed at the axle 12 of the pickup roller 10. When the sheet S is placed, the sheet S contacts the slide 40 located at a higher location in the first position, instead of contacting the pickup roller located at a lower location. A contacting area between the slide 40 and the sheet S is small because the slide is a rib structure. The slide 40 can be made of material with a low friction coefficient, such that the sheet S is not bent by a friction force but placed flat.

As shown in FIG. 4 and FIG. 6, the power source 60 drives the pickup roller 10 to rotate in a counterclockwise direction when the feeding device 100 is activated. The one-way bearing 42 (shown in FIG. 4) disposed at the axle 12 of the pickup roller 10 lowers the slide 40 from the first position to the second position. Since the slide 40 for supporting the sheet S is lowered to the second position below the pickup roller 10, the sheet S drops and contacts the pickup roller 10. The pickup roller 10 rotates to drive the sheet S to pass through the paper passage P and to convey the sheet S to a downstream side of the sheet-feeding roller 20. Then, the sheet-feeding roller 20 cooperates with the friction device 30 to separate the plurality of sheets S. By lowering the slide 40, the sheet S can contact the pickup roller 10 smoothly instead of being bent.

Figure 7:
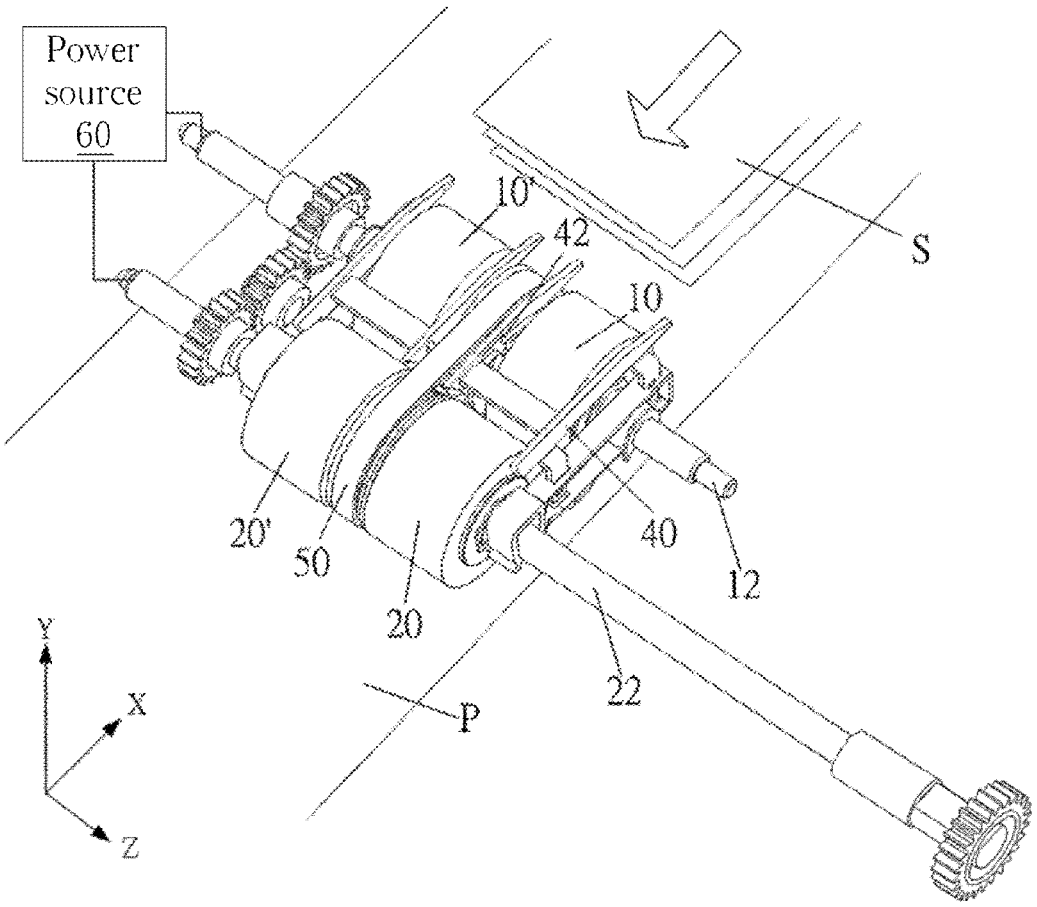
FIG. 7 is a schematic diagram of the feeding device according to a third embodiment of the present invention.

Please refer to FIG. 7. FIG. 7 is a schematic diagram of the feeding device 100 according to a third embodiment of the present invention. Different from the second embodiment, the feeding device 100 further includes an additional pickup roller 10' and an additional sheet-feeding roller 20". The additional pickup roller 10' is coaxially disposed with the pickup roller 10. The additional sheet-feeding roller 20' is coaxially disposed with the sheet-feeding roller 20. The pickup roller 10 and the additional pickup roller 10' can be the same components. The sheet-feeding roller 20 and the additional sheet-feeding roller 20' can be the same components. In such a way, the forces received by the sheet S are balanced and equalized when the sheet are picked up or separated, such that the sheet S is not deflected by ununiformed forces during a sheet-feeding process.

Figure 8:
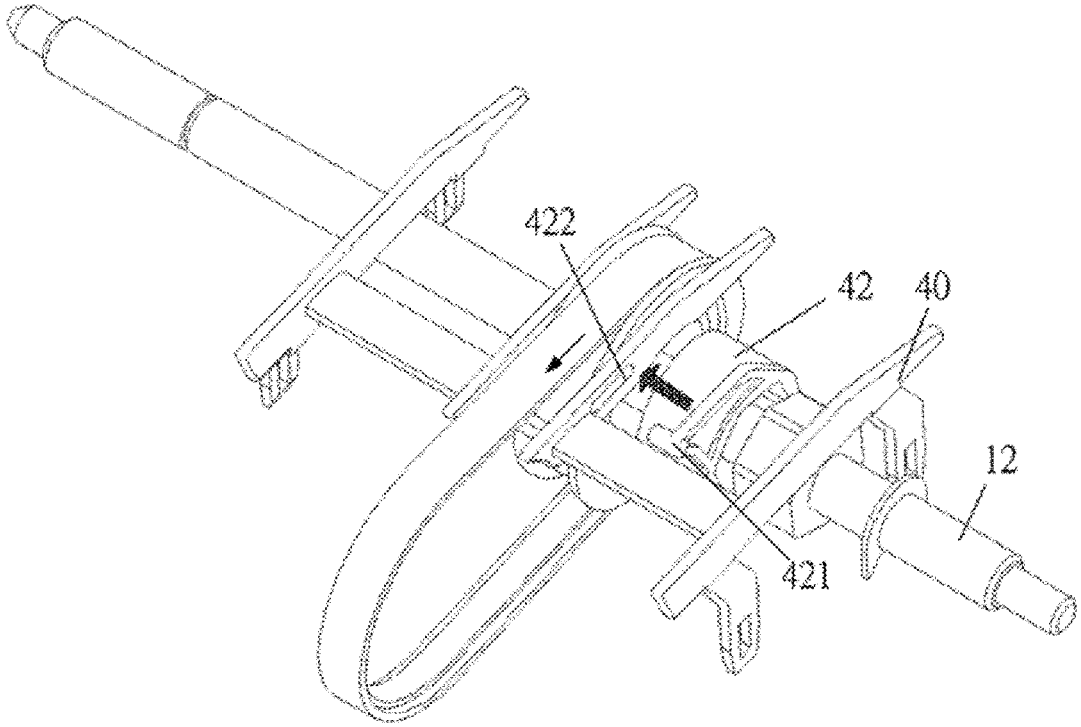
FIG. 8 is a diagram of the slide and a one-way bearing according to the third embodiment of the present invention.
Figure 9:
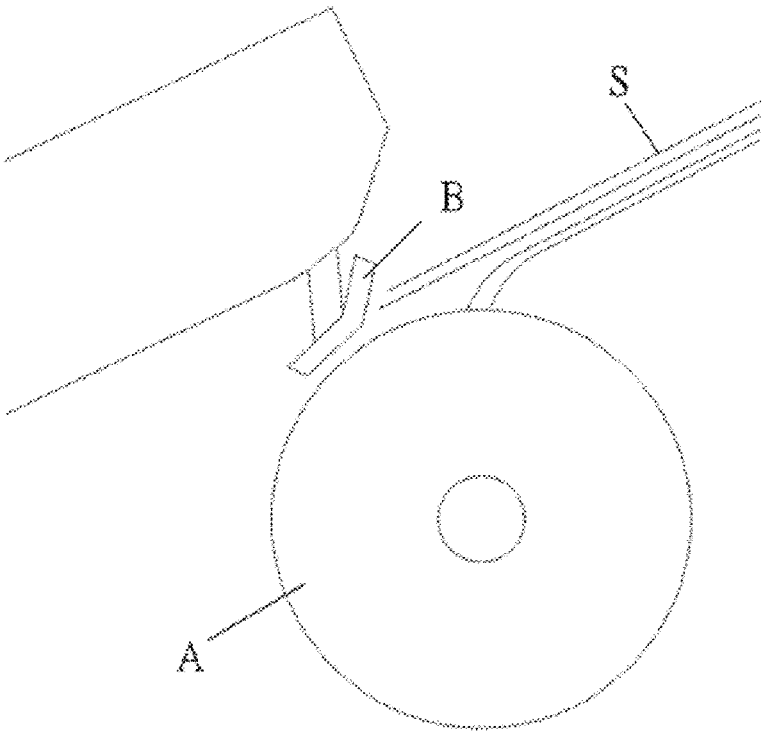
FIG. 9 PRIOR ART
FIG. 9 is a diagram of a conventional feeding device in the prior art.
Figure 10:
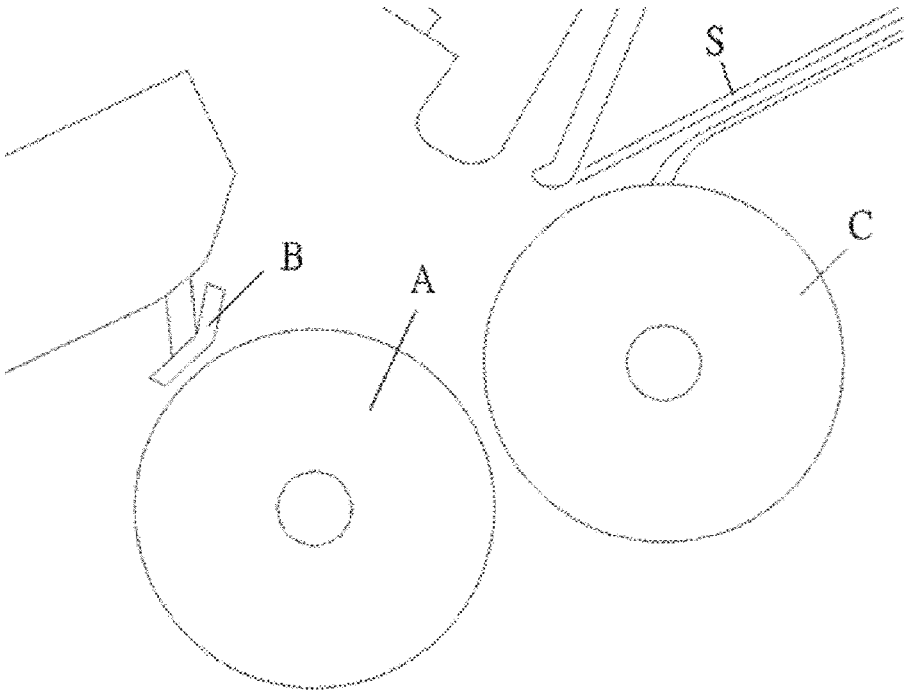
FIG. 10 PRIOR ART
FIG. 10 is a diagram of another conventional feeding device in the prior art.

Please refer to FIG. 8. FIG. 8 is a diagram of the slide 40 and the one-way bearing 42 according to the third embodiment of the present invention. The operational principle of the third embodiment also can be implemented in the first embodiment and in the second embodiment. The slide 40 is disposed at the axle 12 of the pickup roller 10. The one-way bearing 42 is sheathed on the axle 12 of the pickup roller 10 and includes a protrusion 421. The slide 40 includes a sliding slot 422. The protrusion 421 is engaged with the sliding slot 422, as illustrated in the bold arrow shown in FIG. 8 when being assembled. When the axle 12 of the pickup roller 10 is driven to rotate by the power source 60, the one-way bearing 42 rotates and drives the protrusion 421 to slide down in the sliding slot 422, as illustrated in the narrow arrow shown in FIG. 8. Therefore, the slide 40 is pushed down by the protrusion 421 and moved from the higher first position to the lower second position, such that the sheet S contacts the pickup roller 10 flat. However, the operational mechanism of the present invention is not limited to this embodiment, and the slide 40 can be lowered by other mechanisms or devices, such as using a solenoid valve.

In contrast to the prior, the present invention provides the feeding device with the slide capable of switching between the first position and the second position with different heights. The sheet contacts the slide with a lower friction coefficient first at the first position and then contacts the pickup roller or the sheet-feeding roller with a higher friction coefficient at the second position, such that the sheet can be kept flat without being bent during a sheet-feeding process, so as to ensure a smooth feeding process and protect the sheet from damage.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A feeding device for a digital processing machine, the feeding device comprising:

a paper passage;

a pickup roller disposed on the paper passage for picking up a sheet;

a sheet-feeding roller disposed on the paper passage and at a downstream side of the pickup roller;

a friction device disposed at a location opposite to the sheet-feeding roller;

a slide disposed by a left side and a right side of the pickup roller and disposed at an axle of the pickup roller; and a one-way bearing sheathed on the axle of the pickup roller, the one-way bearing lowering the slide from a first position to a second position when the pickup roller rotates, such that the sheet contacts the pickup roller.

2. The feeding device of claim 1, wherein the slide is higher than the pickup roller when the slide is at the first position, and the slide is lower than the pickup roller when the slide is at the second position.

3. The feeding device of claim 1, further comprising a belt encircling the axle of the pickup roller and an axle of the sheet-feeding roller, the belt driving the sheet to pass through the paper passage.

4. The feeding device of claim 1, further comprising an additional pickup roller and an additional sheet-feeding roller, the pickup roller and the additional pickup roller being coaxially disposed with each other, and the sheet-feeding roller and the additional sheet-feeding roller being coaxially disposed with each other.

5. A feeding device for a digital processing machine, the feeding device comprising:

a paper passage;

a pickup roller disposed on the paper passage for picking up a sheet;

a sheet-feeding roller disposed on the paper passage and at a downstream side of the pickup roller;

a friction device disposed at a location opposite to the sheet-feeding roller;

a slide disposed by a left side and a right side of the pickup roller; and a one-way bearing sheathed on an axle of the pickup roller, the one-way bearing lowering the slide from a first position to a second position when the pickup roller rotates, such that the sheet contacts the pickup roller.

6. The feeding device of claim 5, wherein the slide is higher than the pickup roller when the slide is at the first position, and the slide is lower than the pickup roller when the slide is at the second position.

7. The feeding device of claim 5, further comprising a belt encircling the axle of the pickup roller and an axle of the sheet-feeding roller, the belt driving the sheet to pass through the paper passage.

8. The feeding device of claim 5, further comprising an additional pickup roller and an additional sheet-feeding roller, the pickup roller and the additional pickup roller being coaxially disposed with each other, and the sheet-feeding roller and the additional sheet-feeding roller being coaxially disposed with each other.

9. A feeding device for a digital processing machine, the feeding device comprising:

a paper passage;

a sheet-feeding roller disposed on the paper passage;

a friction device disposed at a location opposite to the sheet-feeding roller, the sheet-feeding roller separating a sheet with the friction device;

a slide disposed by a left side and a right side of the sheet-feeding roller and moving with rotation of the sheet-feeding roller; and a one-way bearing sheathed on an axle of the sheet-feeding roller, the one-way bearing lowering the slide from a first position to a second position when the sheet-feeding roller rotates;

wherein the slide is lowered from the first position to the second position when the sheet-feeding roller rotates, such that the sheet contacts the sheet-feeding roller.

10. The feeding device of claim 9, wherein the slide is higher than the sheet-feeding roller when the slide is at the first position, and the slide is lower than the sheet-feeding roller when the slide is at the second position.

11. The feeding device of claim 9, wherein the slide is disposed at the axle of the sheet-feeding roller.

* * * * *